US010234251B2

(12) United States Patent
Ans et al.

(10) Patent No.: US 10,234,251 B2
(45) Date of Patent: Mar. 19, 2019

(54) UNIVERSAL NOCK SYSTEM

(71) Applicant: Hunter's Manufacturing Company, Inc., Suffield, OH (US)

(72) Inventors: Greg Ans, Brooklyn, OH (US); Dean Mook, Akron, OH (US); Michael Shaffer, Mogadore, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/689,447

(22) Filed: Aug. 29, 2017

(65) Prior Publication Data

US 2018/0058828 A1 Mar. 1, 2018

Related U.S. Application Data

(60) Provisional application No. 62/381,077, filed on Aug. 30, 2016.

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/578
See application file for complete search history.

(56) References Cited

U.S. PATENT DOCUMENTS 4,544,463 A 10/1985 Scanlon
5,067,731 A * 11/1991 Bickel ..... F42B 6/06 473/578
5,154,432 A * 10/1992 Saunders ..... F42B 6/06 473/578
5,154,532 A 10/1992 Saunders
5,186,470 A * 2/1993 Easton ..... F42B 6/06 473/578
5,547,200 A * 8/1996 Rangel ..... F42B 6/04 403/282
5,803,843 A * 9/1998 Anderson ..... F42B 6/06 403/277
5,987,724 A * 11/1999 Kleman ..... F41B 5/1446 269/38
6,203,457 B1 * 3/2001 Snook ..... F42B 6/06 473/586
8,382,616 B2 * 2/2013 Marshall ..... F42B 6/06 473/578

(Continued)

*Primary Examiner* — Alexander Niconovich
(74) *Attorney, Agent, or Firm* — Emerson Thomson Bennett, LLC

(57) ABSTRACT

Provided is a universal nock system comprising a first axis defining an axial direction and radial directions perpendicular to the axial direction; a nock having, a first side having a bowstring reception surface having concave channels, a second side opposite the first side, an axial contact surface, and an exterior surface; an insert portion extending from the second side of the nock, elongated along the first axis, and adapted for insertion into an associated arrow body, the insert portion having, a first end, a second end opposite the first end having a centering feature of the second end, the centering feature of the second end having contact surfaces, and a middle portion located along the first axis of elongation between the first end and the second end, the middle portion having a centering feature of the middle portion, the centering feature of the middle portion having contact surfaces.

17 Claims, 16 Drawing Sheets

(56) References Cited

U.S. PATENT DOCUMENTS

| | | | | |
|---|---|---|---|---|
| 8,622,855 | B2 * | 1/2014 | Bednar | F41B 5/1415 473/578 |
| 8,777,786 | B1 * | 7/2014 | Bay | F42B 6/06 473/578 |
| 8,845,464 | B1 * | 9/2014 | Hyde | F42B 6/06 473/578 |
| 9,028,347 | B2 * | 5/2015 | Pedersen | F42B 6/06 473/578 |
| 9,074,837 | B2 * | 7/2015 | Bednar | F41B 5/148 |
| 9,285,195 | B1 * | 3/2016 | Palomaki | F42B 6/06 |
| 9,383,177 | B1 * | 7/2016 | Kallmes | F42B 10/02 |
| 9,441,925 | B1 * | 9/2016 | Palomaki | F42B 6/06 |
| 9,618,304 | B2 * | 4/2017 | Pedersen | F42B 6/02 |
| 9,714,818 | B2 * | 7/2017 | Mook | F42B 6/06 |
| 9,746,294 | B2 * | 8/2017 | Palomaki | F42B 6/06 |

* cited by examiner

UNIVERSAL NOCK SYSTEM

CROSS-REFERENCE TO RELATED APPLICATIONS

This application claims the benefit of U.S. Provisional Application No. 62/381,077, filed Aug. 30, 2016, the entirety of which is fully incorporated by reference herein.

I. BACKGROUND

The present subject matter is directed to arrows. More specifically the present subject matter is directed to a nock system for an arrow.

There are multiple technical challenges present in current arrow technology. One of these challenges is manufacturing arrows quickly, cost-effectively, and at acceptable operational quality having the proper nock and fletching orientation.

Providing a universal nock system that provides a simple, easy, and quick method for establishing proper nock and fletching orientation remains desirable.

II. SUMMARY

In accordance with one aspect of the present subject matter provided is a universal nock system comprising a first axis defining an axial direction and radial directions perpendicular to the axial direction; a nock having, a first side having a bowstring reception surface having concave channels, a second side opposite the first side, an axial contact surface, and an exterior surface; an insert portion extending from the second side of the nock, elongated along the first axis, and adapted for insertion into an associated arrow body, the insert portion having, a first end, a second end opposite the first end having a centering feature of the second end, the centering feature of the second end having contact surfaces, and a middle portion located along the first axis of elongation between the first end and the second end, the middle portion having a centering feature of the middle portion, the centering feature of the middle portion having contact surfaces.

Still other benefits and advantages of the present subject matter will become apparent to those skilled in the art to which it pertains upon a reading and understanding of the following detailed specification.

III. BRIEF DESCRIPTION OF THE DRAWINGS

Figure 1A:
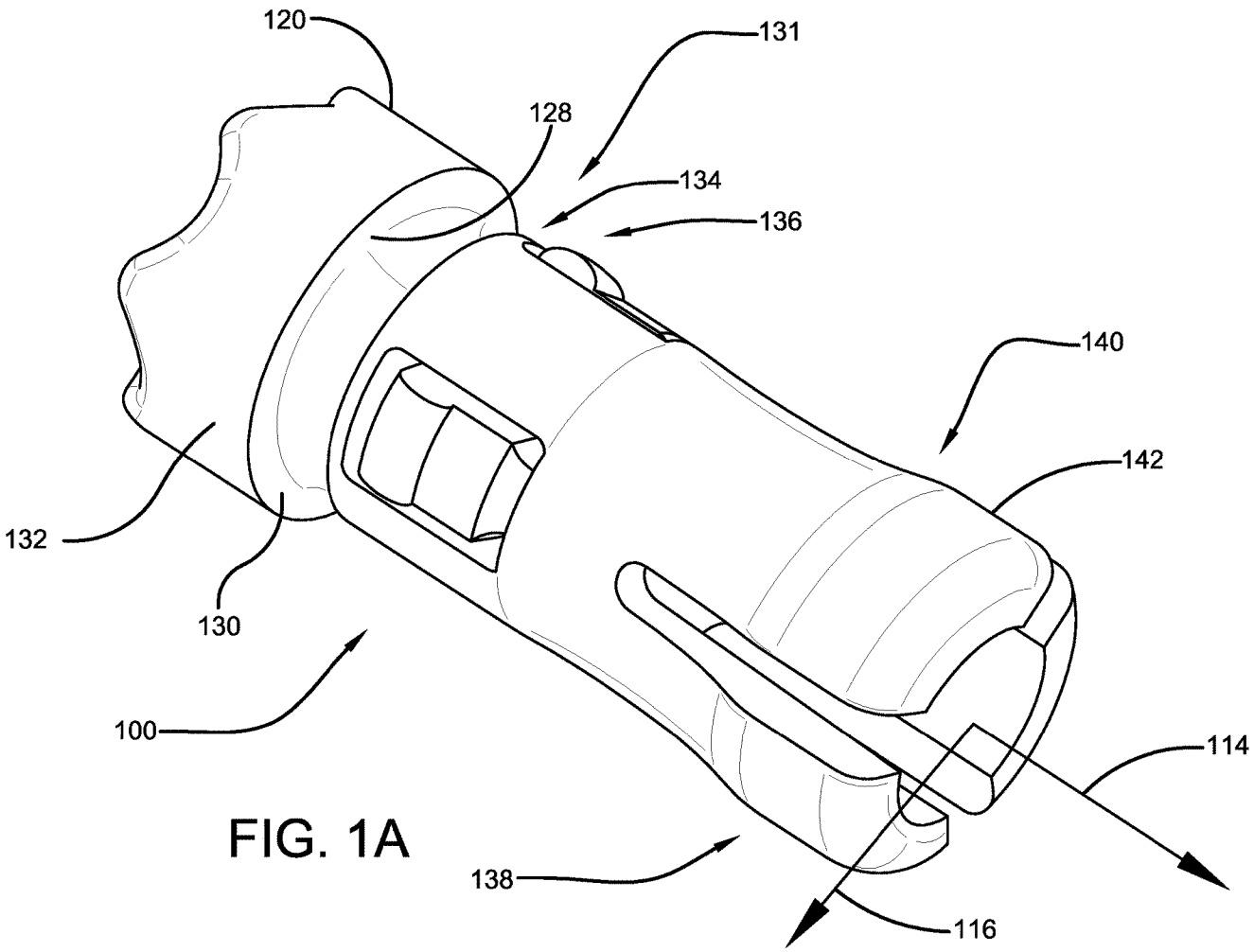

The invention may take physical form in certain parts and arrangement of parts, embodiments of which will be described in detail in this specification and illustrated in the accompanying drawings which form a part hereof and wherein:

FIG. 1*a* is a perspective view of one embodiment of a nock insert.

Figure 1B:
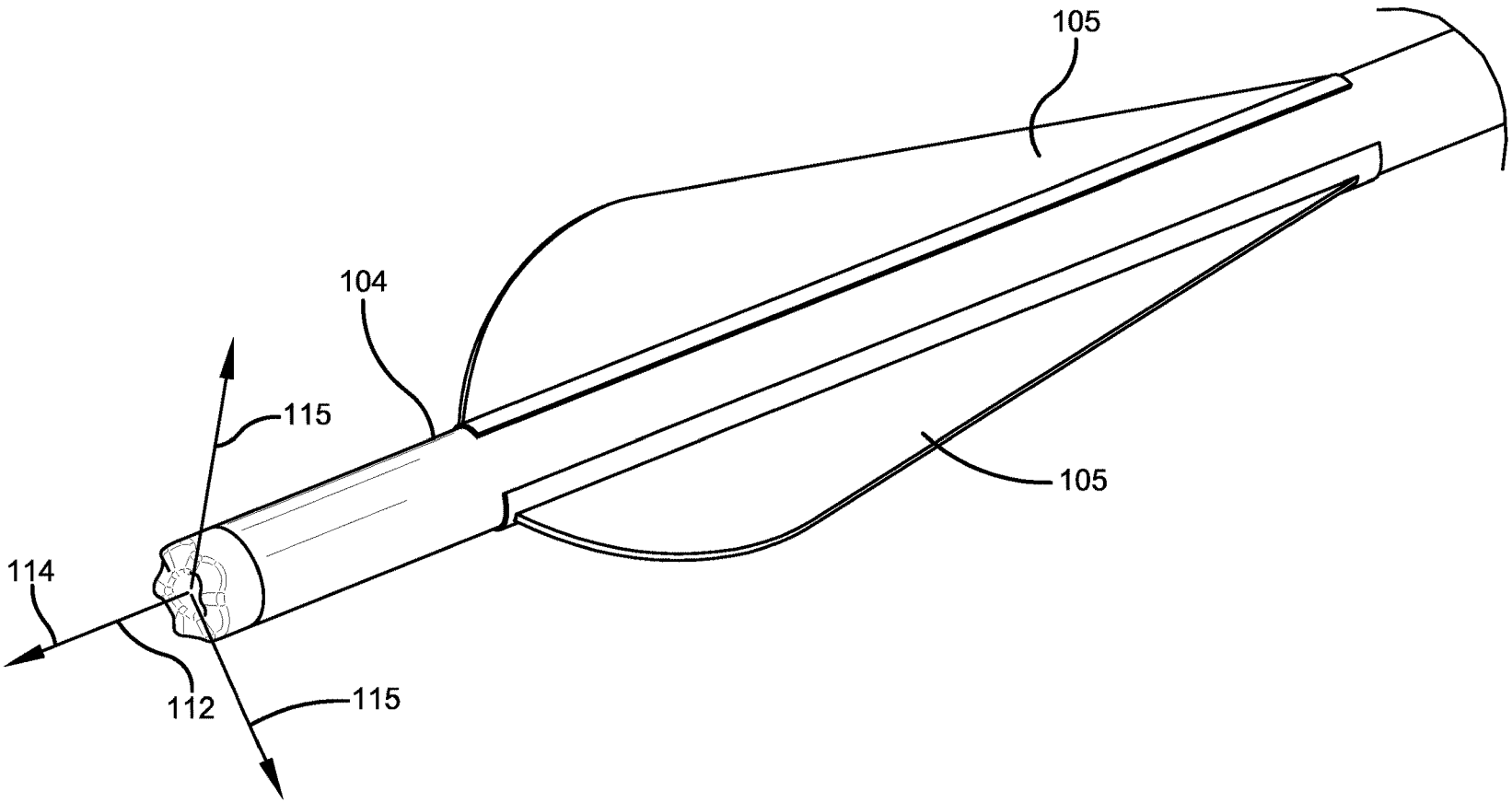

FIG. 1*b* is a perspective view of one embodiment of a nock insert engaged with an associated arrow body.

Figure 1C:
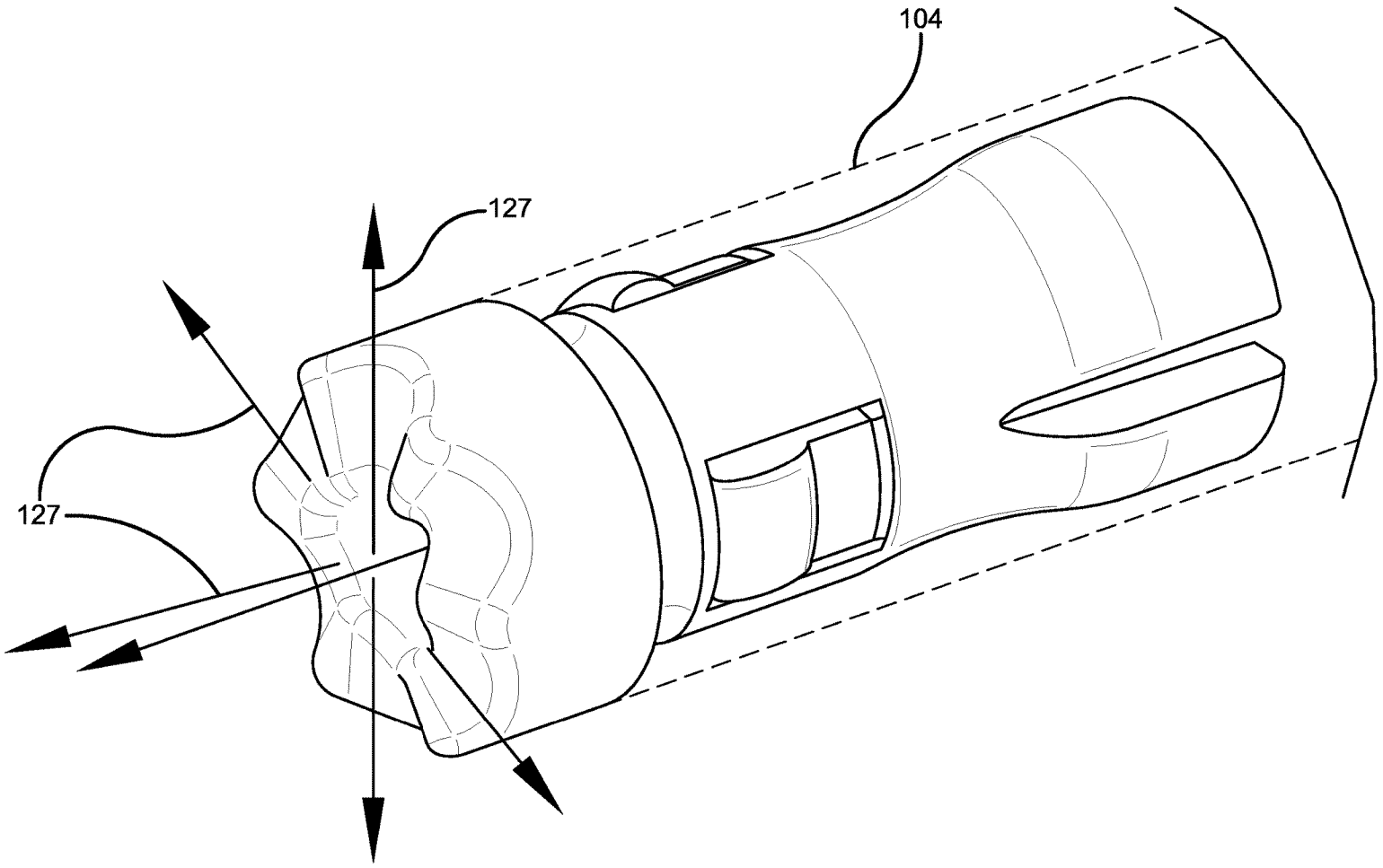

FIG. 1*c* is a perspective view of one embodiment of a nock insert engaged with an associated arrow body shown in phantom form.

Figure 2A:
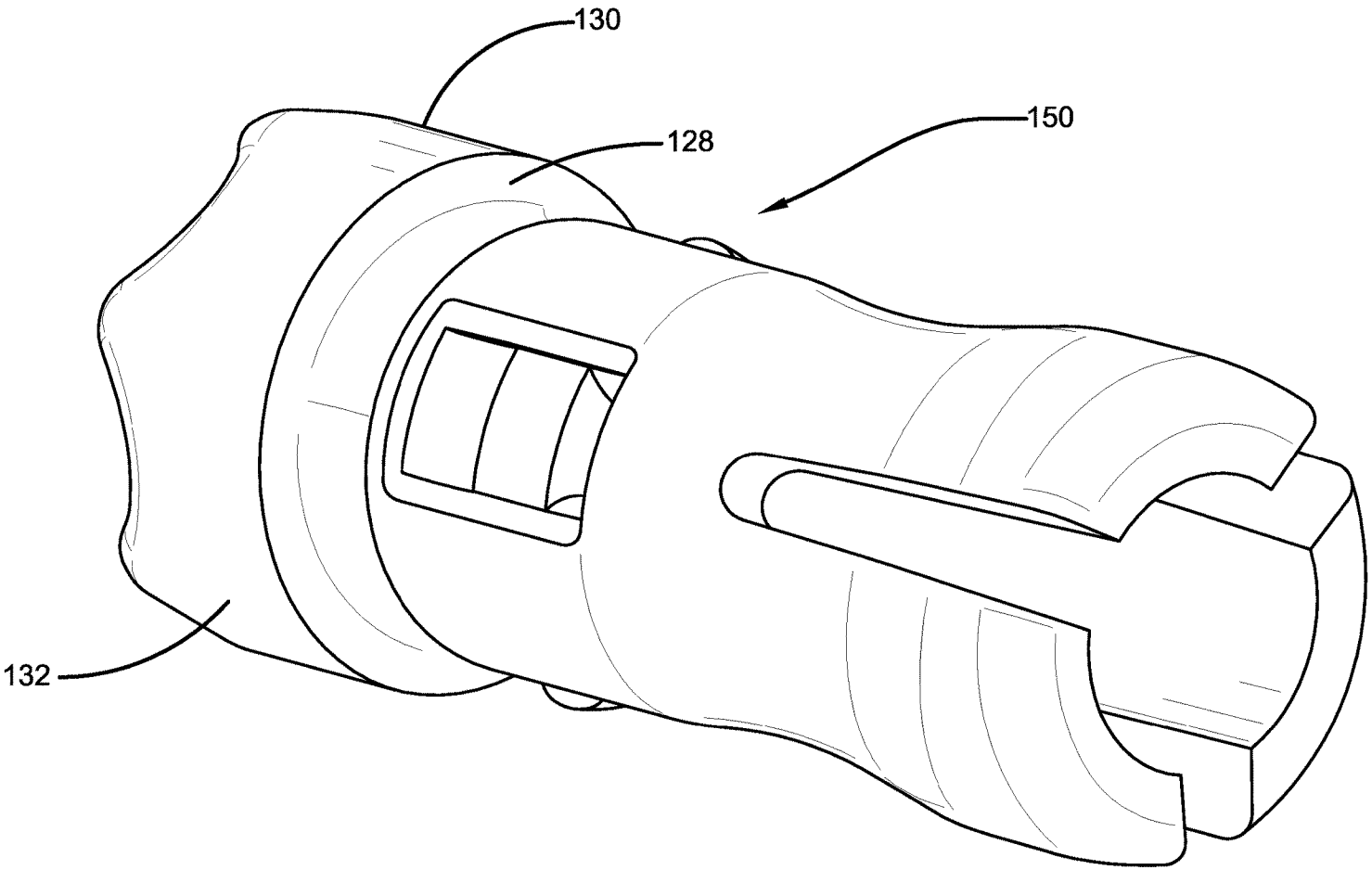

FIG. 2*a* is a perspective view of one embodiment of a nock insert.

Figure 2B:
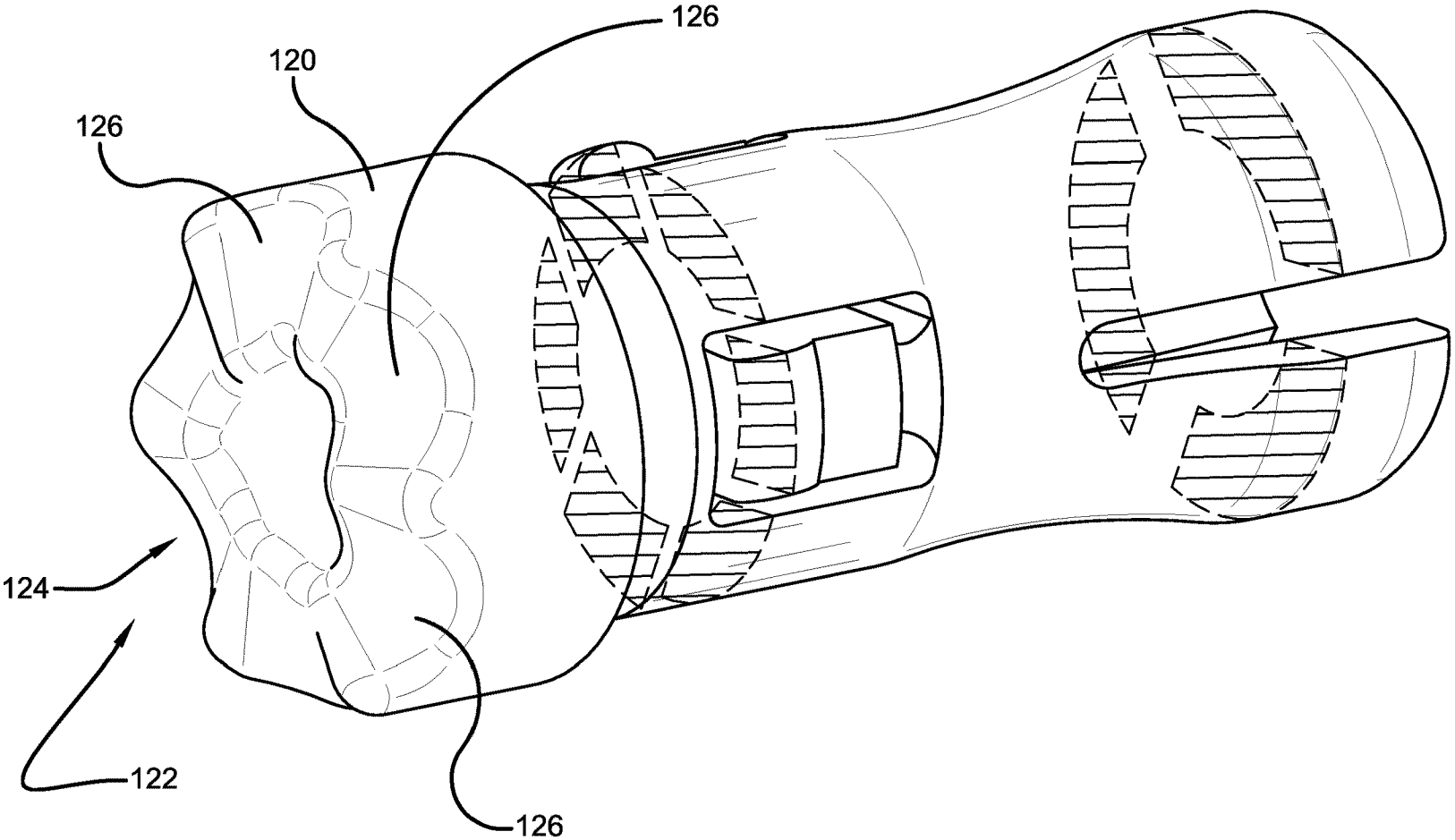

FIG. 2*b* is a perspective view of one embodiment of a nock insert.

Figure 2C:
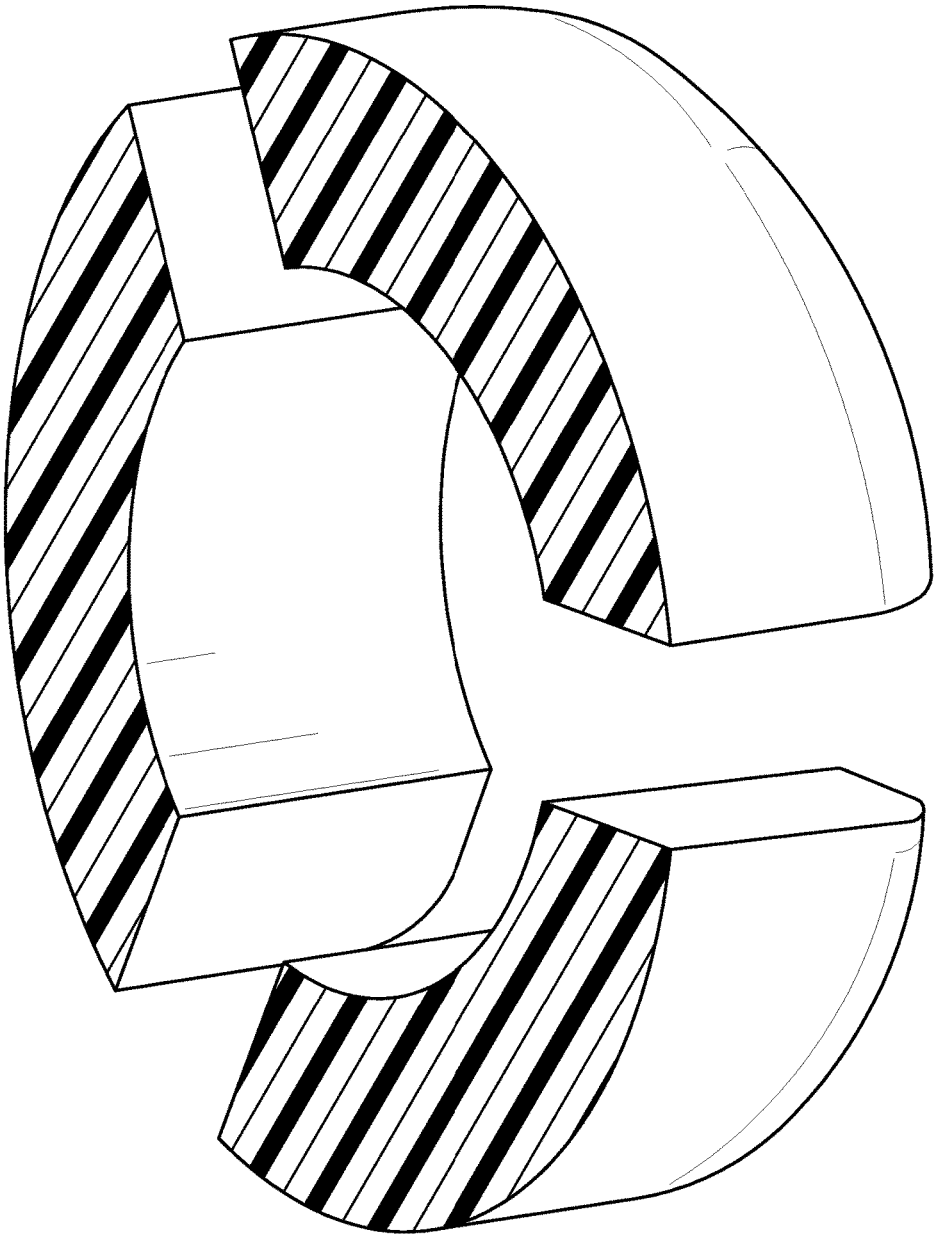

FIG. 2*c* is a perspective view of a section of the nock insert of FIG. 2*b*.

Figure 2D:
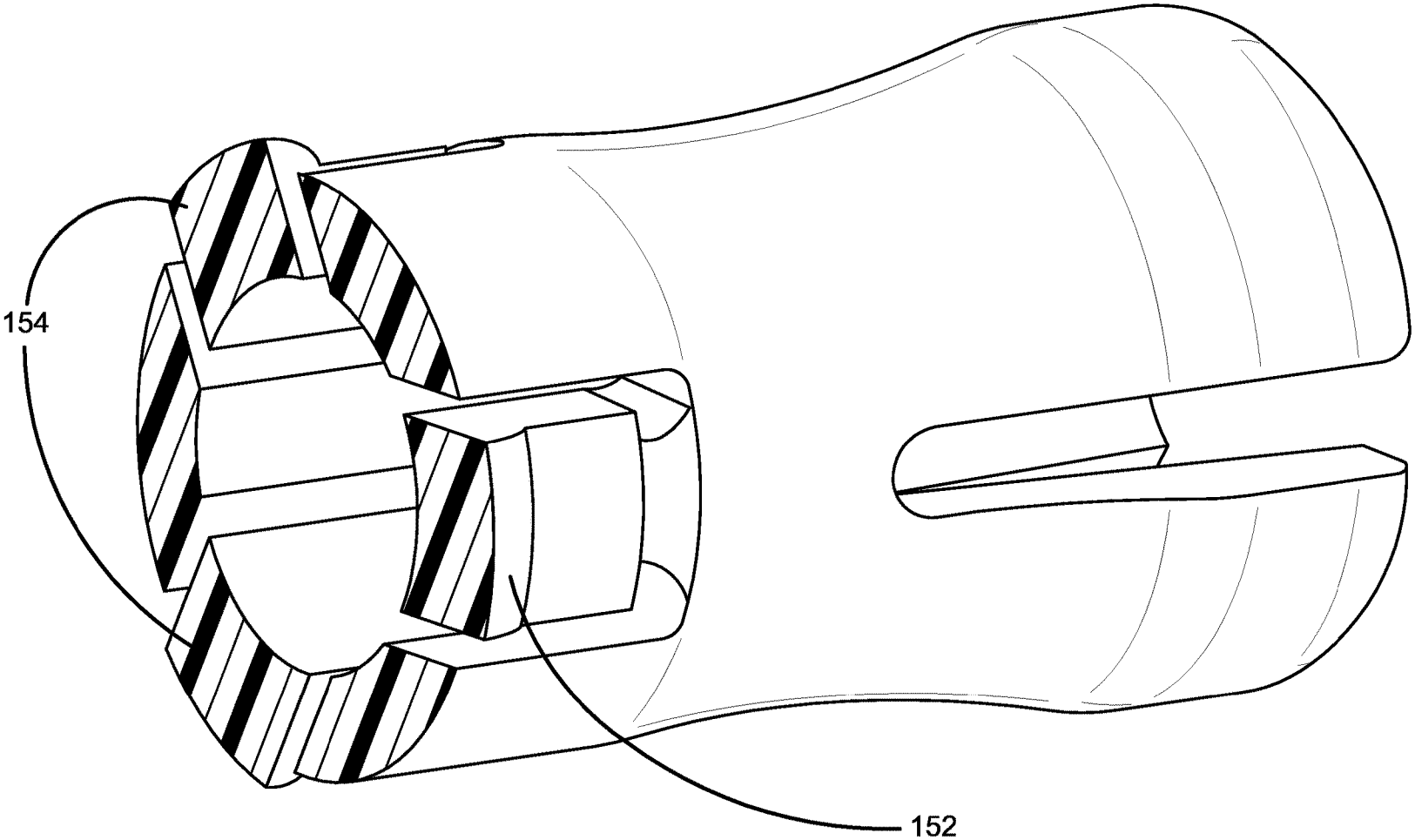

FIG. 2*d* is a perspective view of a section of the nock insert of FIG. 2*b*.

Figure 2E:
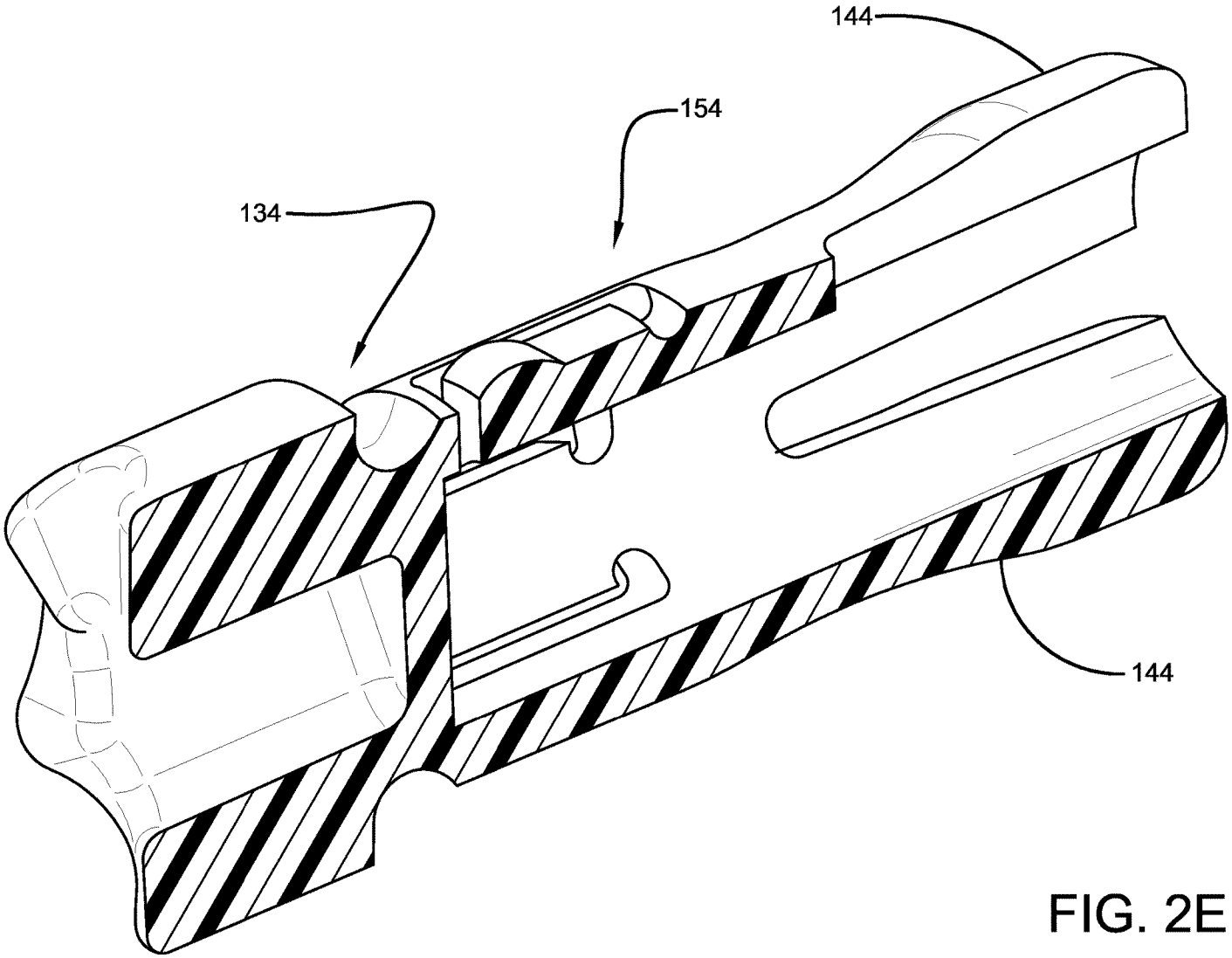

FIG. 2*e* is a perspective view of a section of the nock insert of FIG. 2*b*.

Figure 3A:
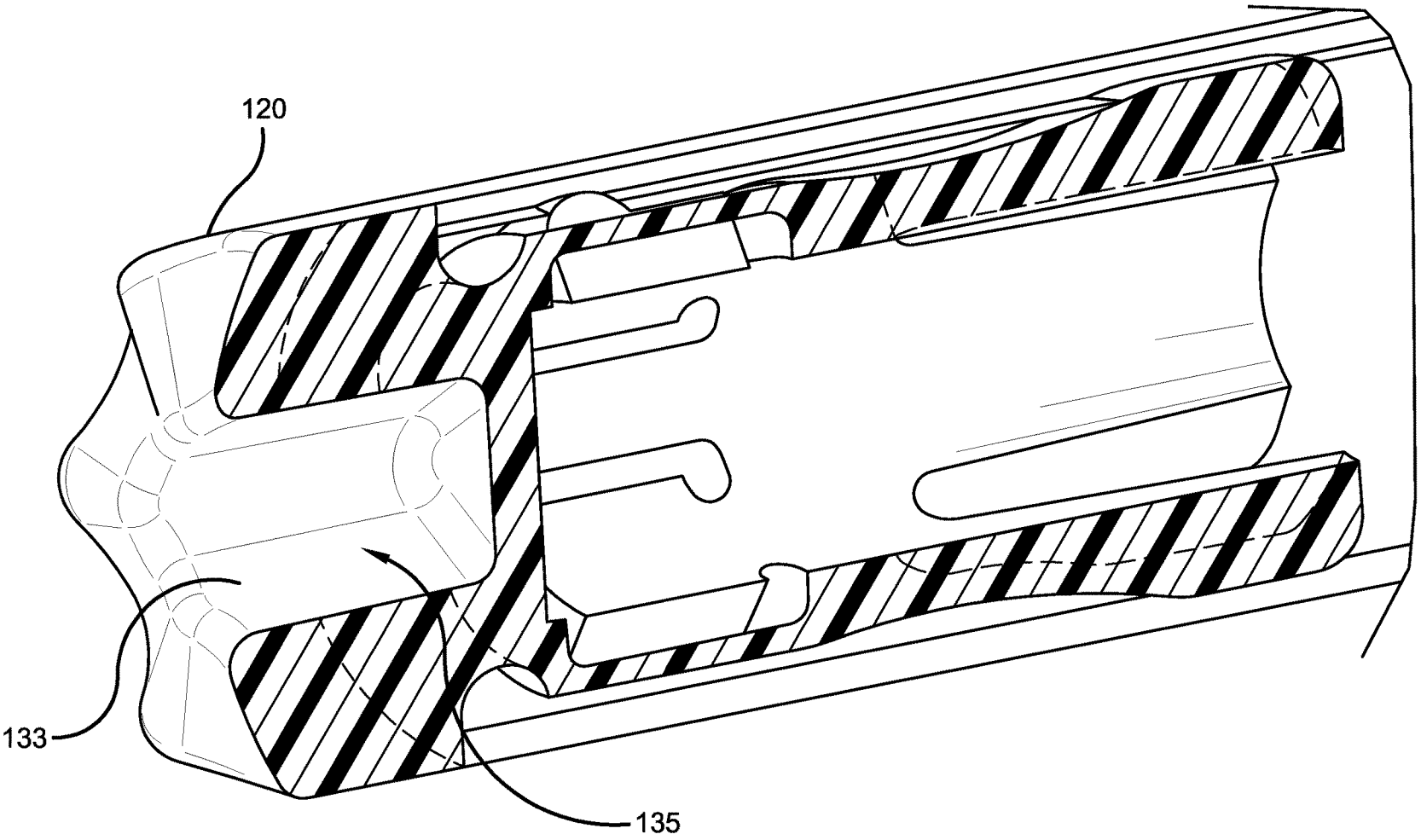

FIG. 3*a* is a perspective view of a section of a nock insert engaged with an associated arrow body.

Figure 3B:
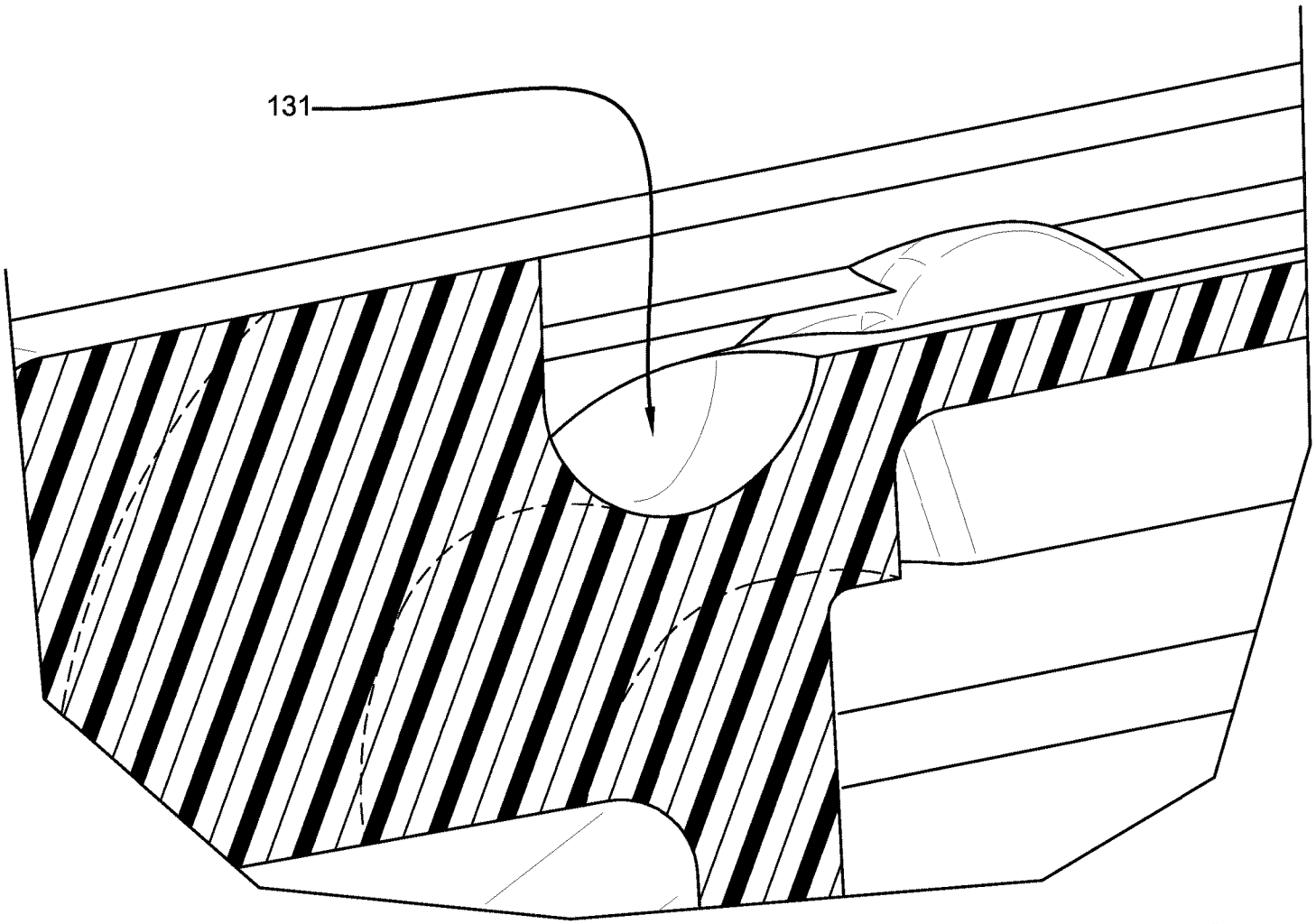

FIG. 3*b* is a detail view of a portion of the perspective view of FIG. 3*a*.

Figure 3C:
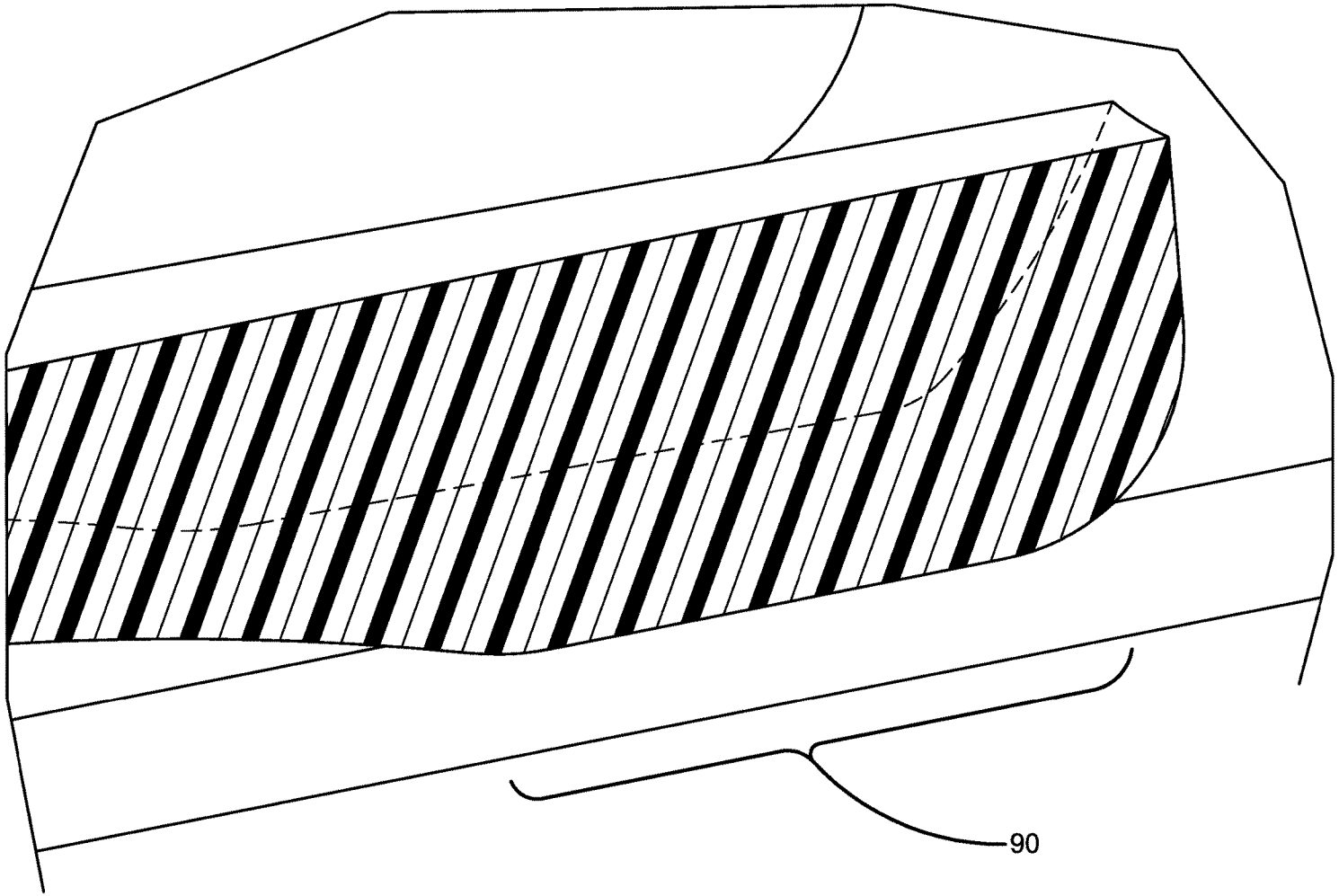

FIG. 3*c* is a detail view of a portion of the perspective view of FIG. 3*a*.

Figure 4A:
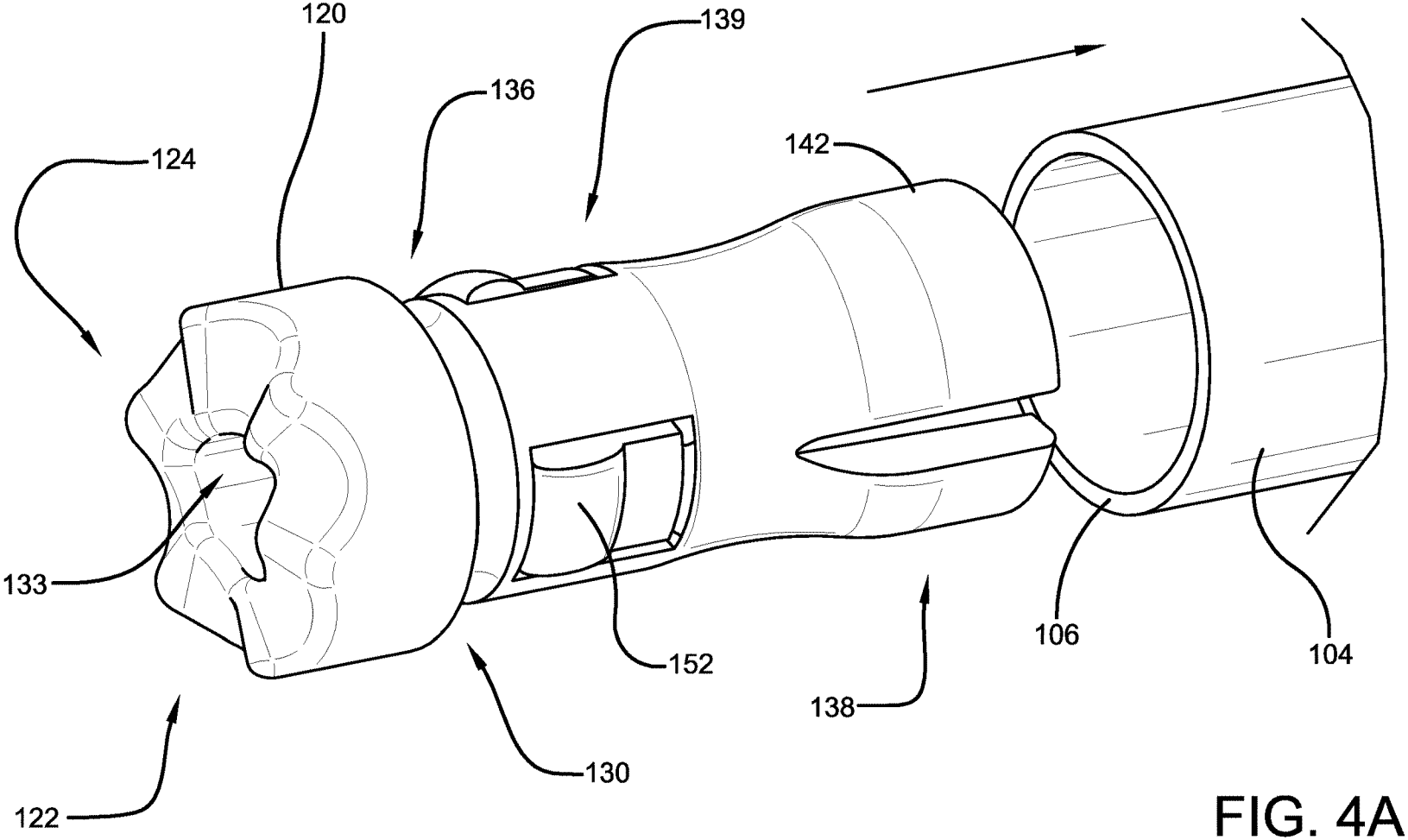

FIG. 4*a* is a perspective view showing engagement of a nock insert with an associated arrow body.

Figure 4B:
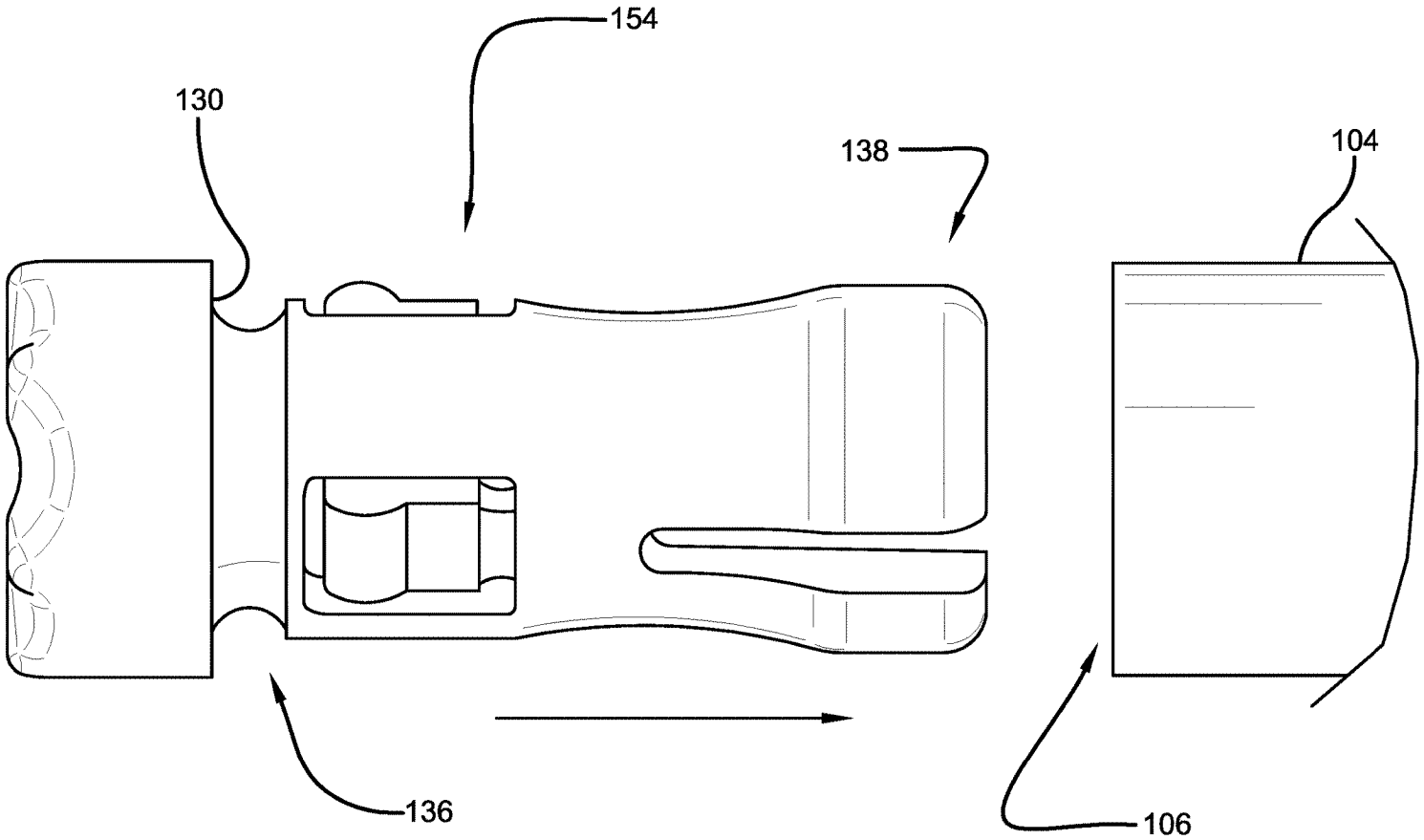

FIG. 4*b* is a side view showing engagement of a nock insert with an associated arrow body.

Figure 4C:
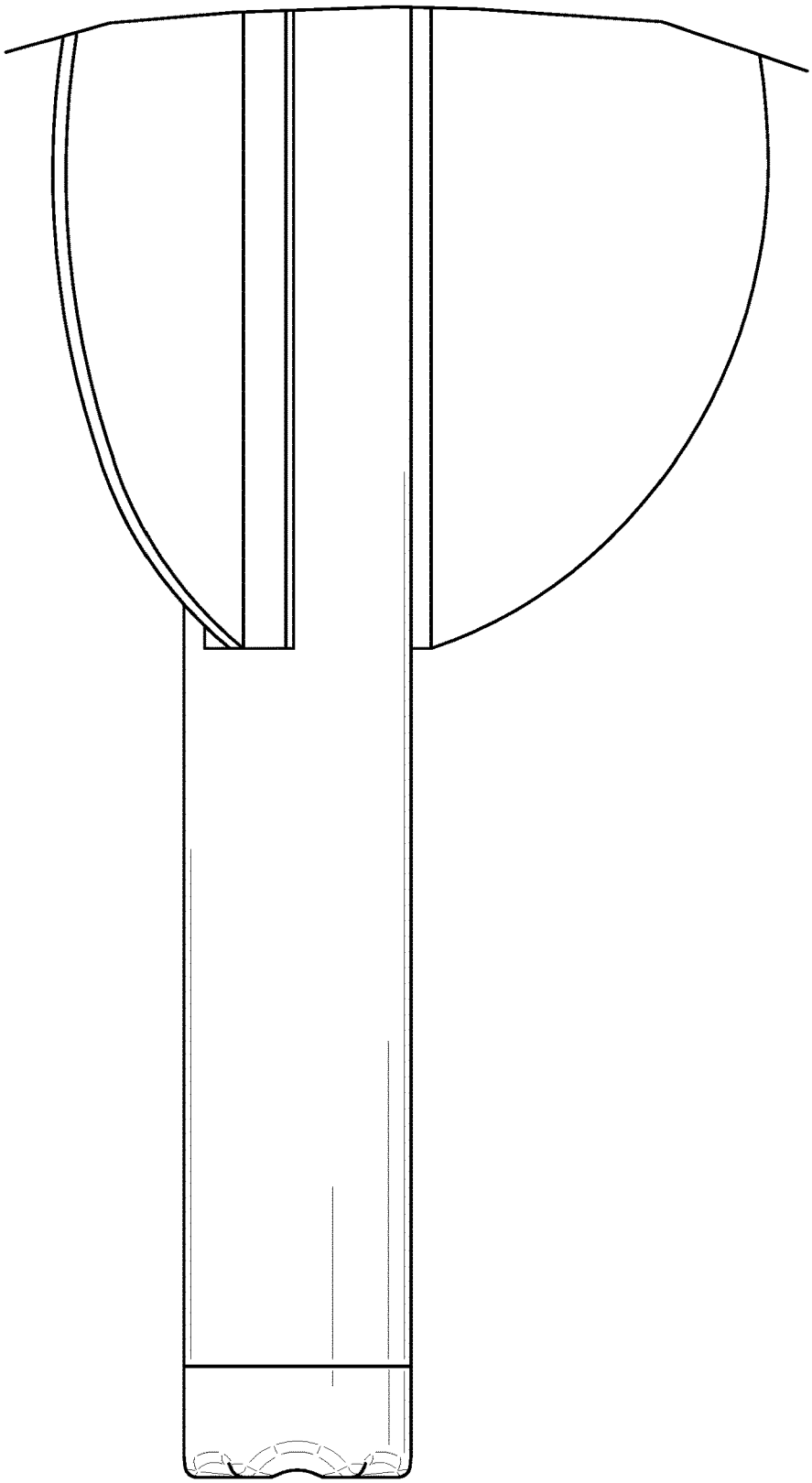

FIG. 4*c* is a side view of a nock insert engaged with an associated arrow body.

Figure 5A:
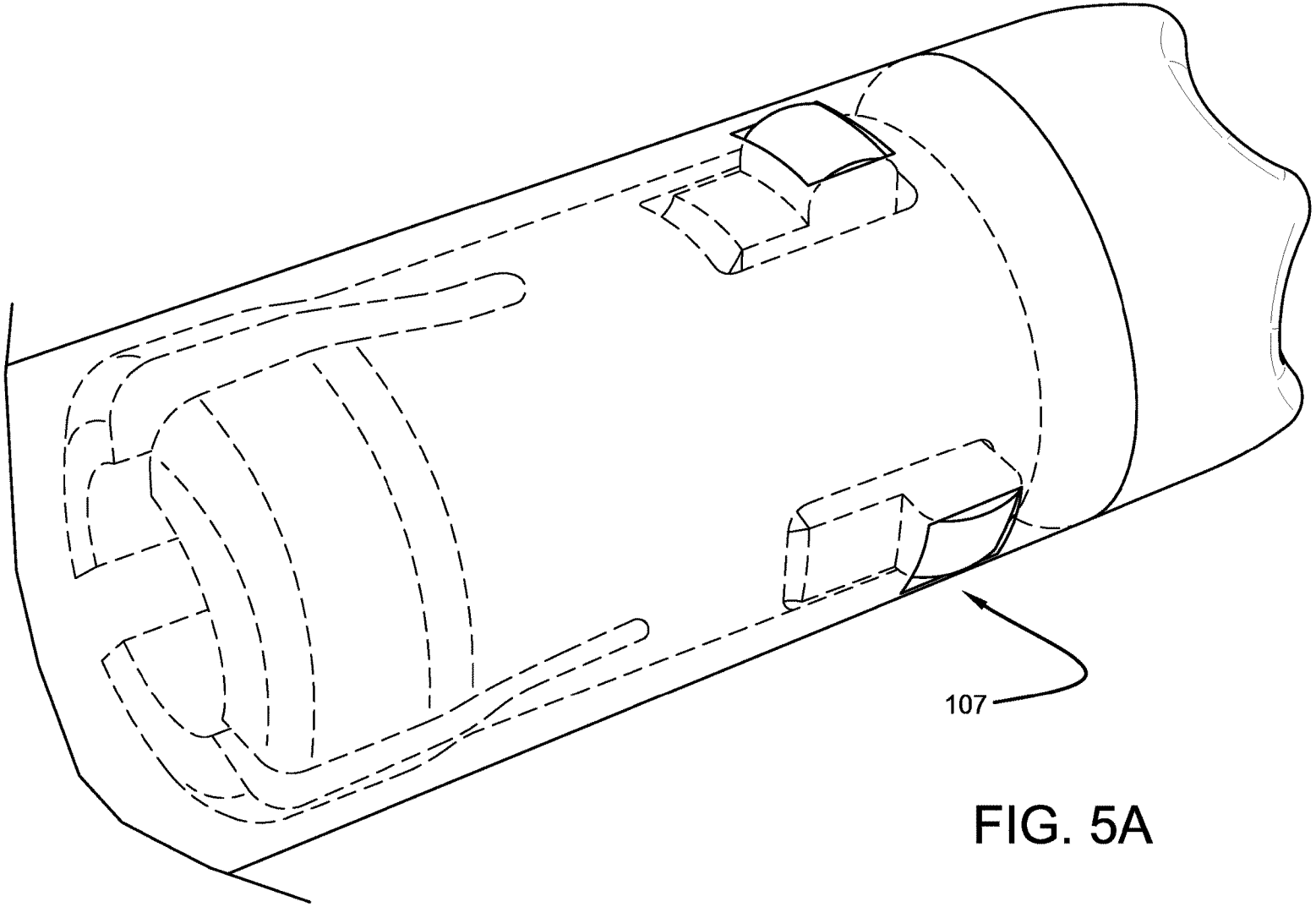

FIG. 5*a* is a perspective view of a nock insert engaged with an associated arrow body.

Figure 5B:
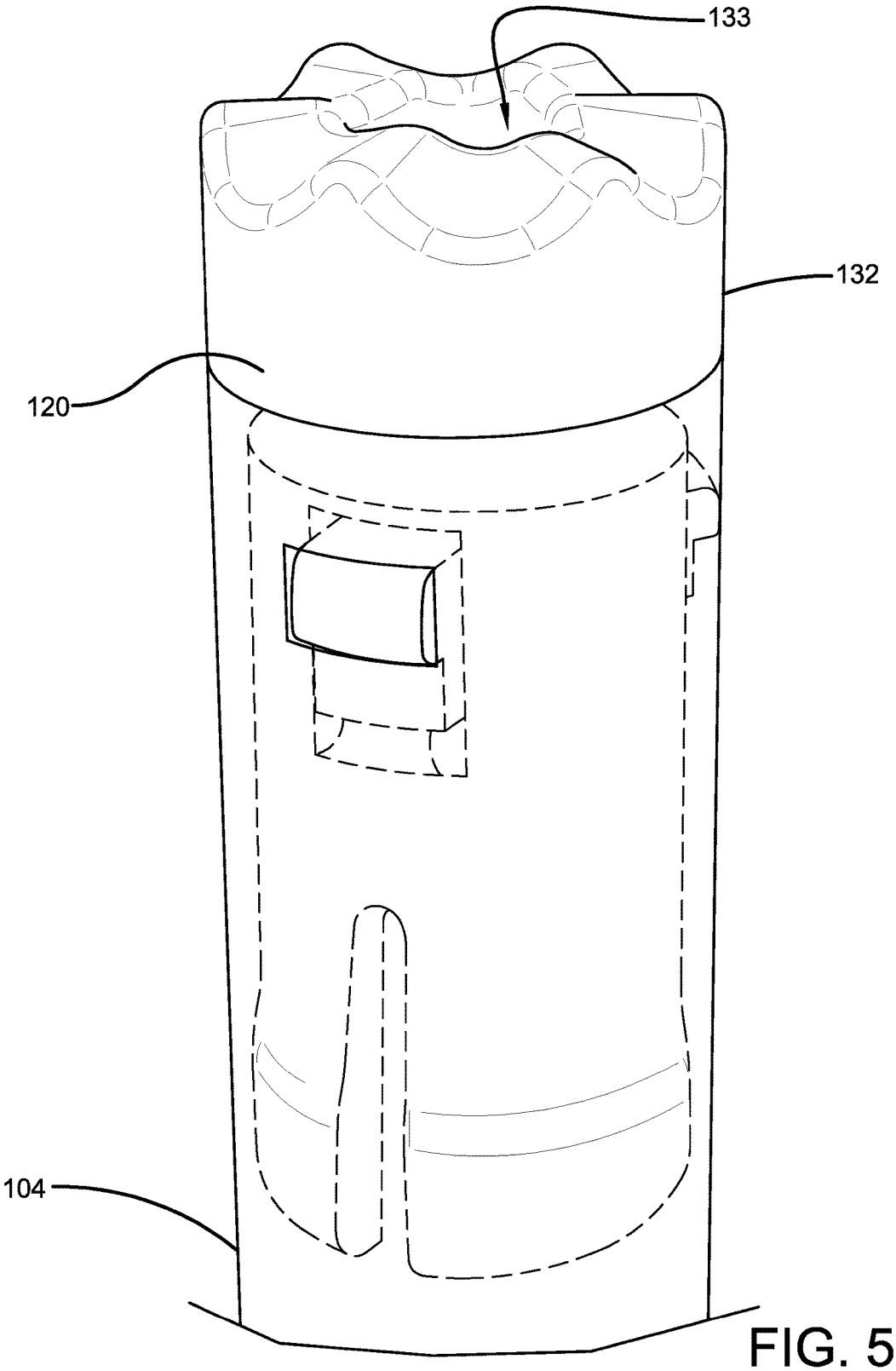

FIG. 5*b* is a perspective view of a nock insert engaged with an associated arrow body.

IV. DETAILED DESCRIPTION

Referring now to the drawings wherein the showings are for purposes of illustrating embodiments of the present subject matter only and not for purposes of limiting the same, and wherein like reference numerals are understood to refer to like components, provided is a crossbow cocking system and a method for using same.

In a first embodiment, a universal nock system 100 may comprise a first axis of elongation 112, a nock portion 120, and an insert portion 134.

In the first embodiment, the first axis of elongation 112 may define an axial direction 114 and radial directions 115. Each radial direction 115 may be perpendicular to the axial direction 114.

In the first embodiment, the nock portion 120 may have a first side 122 having a bowstring reception surface 124 having multiple concave channels 126, a second side 128 opposite the first side 122, and having an axial contact surface 130, and an exterior surface 132 extending between the first side 122 and the second side 128.

In general, a nock is useful to operationally engage an associated arrow body 104 with an associated bowstring prior to and during a firing operation in order to promote transmission of the firing energy from the bowstring (not shown) to the associated arrow body 104 in the manner intended by an associated user. A bowstring reception surface 124 may have a number, N, of concave channels 126 wherein N is an integer greater than 2. Each concave channel 126 is adapted to operationally receive an associated bowstring (not shown). Each concave channel 126 is adapted to transmit forces, or energy, or both from the associated bowstring (not shown) during a firing operation. In the embodiment shown in FIGS. 1*a*-5*b*, the bowstring reception surface 124 has three concave channels 126. The embodiment shown in FIGS. 1*a*-5*b* is not limiting in general and a bowstring reception surface 124 may have 1, 2, 3, 4, 5, 6 or more concave channels 126.

In the non-limiting embodiment shown in FIGS. 1*a*-5*b*, each of the concave channels 126 defines a channel axis 127 that is substantially perpendicular to the first axis of elongation 112 and is oriented at an angle .Theta. about the first axis of elongation 112 with respect to at least one other channel axis 127. In certain embodiments, .Theta. may be 360/N degrees. In the non-limiting embodiments where N is 3, .Theta, is 120 degrees. It should be understood that as used in this document, each concave channel 126 and the corresponding channel axis 127 defined thereby extends across the first axis of elongation 112 so that in the non-limiting embodiment shown in FIGS. 1*a*-5*b*, there are three concave channels 126 and three channel axes 127.

As shown in the drawings, the axial contact surface 130 is adapted to engage an associated arrow body 104. As can be seen in the non-limiting embodiment shown in FIGS. 4*a* and 4*b*, the axial contact surface 130 may be axial facing in a first direction, the associated arrow body 104 may comprise an axial facing arrow body surface 106 facing in a second direction, wherein the second direction is opposite the first direction so that the axial contact surface 130 and the axial facing arrow body surface 106 may be engaged with one another and thereby the axial contact surface may be engaged with the associated arrow body 104 in a manner to transmit forces from the associated bowstring, through the nock portion 120, and to the associated arrow body 104 during a firing operation.

In the non-limiting embodiment shown in FIGS. 1*a*-5*b*, the universal nock system 100 may further have an insert portion 134 extending from the second side 128 of the nock portion 120, elongated along the first axis of elongation 112, and adapted for insertion into an associated arrow body 104. The insert portion 134 may have a first end 136 adjacent to the second side 128 and a second end 138 opposite the first end. The second end 138 may have a centering feature 140 of the second end 138, the centering feature 140 of the second end 138 may have a plurality of contact surfaces 142 facing in a radial direction 115. The second end 138 may have a middle portion 139 located along the first axis of elongation 112 between the first end 136 and the second end 138, the middle portion 139 having a centering feature 150 of the middle portion 139, the centering feature 150 of the middle portion 139 having a plurality of contact surfaces 152 facing in a radial direction 115.

In the non-limiting embodiment shown in FIGS. 1*a*-5*b*, the nock portion 120 may further comprise an interior surface 133 defining a hole 135 extending into the nock portion 120 from the bowstring reception surface 124. The hole 135 may be non-circular, comprise one or more flat surfaces, or otherwise defines or acts as a torque receptacle adapted to transmit a torque about the first axis of elongation. In the non-limiting embodiment shown in FIGS. 1*a*-5*b*, a wrench or other tool (not shown) may be inserted into the hole 135 and used to apply a torque to the nock portion 120 to induce it to rotate about the first axis of elongation 112. In some embodiments the latter torsion applied may rotate the nock portion 120 about the first axis of elongation 112 with respect to an associated arrow body 104.

In the non-limiting embodiment shown in FIGS. 1*a*-5*b*, the nock portion may have an annular groove 131. In some embodiments with an annular groove 131, the annular groove 131 may be defined by a fillet radius between the axial contact surface 130 and the insert portion 134. In some embodiments the annular groove 131 may be defined by a fillet radius tangent to the axial contact surface 130. An annular groove 131 may be adapted to serve as an overrun glue well. An overrun glue well is an adaptation to receive excess glue or other adhesive used to bond the nock portion 120 to an associated arrow body 104. As can be seen in the non-limiting embodiment shown in FIGS. 1*a*-5*b*, the annular groove 131 defines a cavity within the assemblage of the nock portion 120 and an associated arrow body 104, such that the annular groove can accept excess material such glue and other adhesives. An annular groove 131 may be adapted to serve as stress relief feature. Sharp corners or small radius fillets can act as stress concentration regions, a larger groove such as annular groove 131 may prevent or relieve such concentrated stress. Annular groove 131 may also serve as a geometric relief to accommodate eccentricities or flaws on an associated arrow body 104, such as and without limitation, a burr on the interior diameter of associated arrow body 104, which could otherwise prevent the nock portion 120 from being engaged concentrically with an associated arrow body 104.

In those embodiments of the universal nock system 100 in which it comprises an insert portion 134 having a second end 138 having a centering feature 140 of the second end 138, the second end may have a plurality of contact surfaces 142. In some embodiments, the contact surfaces 142 may each be defined by an axially-extending, integrally-molded, elongated spring tab 144 having a free end biased outwardly in a radial direction 115 and adapted to be radially deflected upon insertion of the insert portion 134 into an associated arrow body 104. As can be seen in the non-limiting embodiment shown in FIG. 3*a*, the contact surfaces 142 each define an axially-extending, integrally-molded, elongated spring tab 144 which, when engaged with the associated arrow body 104 would form an interference fit in their free state, (shown interfering at region 90 of FIG. 3*c* for reference purposes) such that in operational engagement the spring tab 144 will be deflected radially to relieve at least a portion of the interference. It should be understood that the associated arrow body 104 is not perfectly ridged so that it will also undergo some very small deflection to relieve a portion of the interference. The mutual deflection to relieve the interference fit between the associated arrow body 104 and the spring tab 144 is a strain in each of the associated arrow body 104 and the spring tab 144. This strain correlates to a corresponding stress and force in both the associated arrow body 104 and the spring tab 144 such that there will be a radial reaction force between the associated arrow body 104 and the spring tab 144 resulting from the deflection of operational engagement. In some embodiments the radial reaction force will produce a corresponding frictional retaining force between the associated arrow body 104 and the spring tab 144. In some non-limiting embodiments, the centering feature 140 of the second end 138 has three contact surfaces 142, each offset from the other two contact surfaces 142 of the centering feature 140 of the second end 138 by 120 degrees. In some non-limiting embodiments, the centering feature 140 of the second end 138 has single contact surface 142. In some non-limiting embodiments, the centering feature 140 of the second end 138 has multiple contact surfaces 142, offset from one or more other contact surfaces 142 by some axial distance. In some non-limiting embodiments, one or more of the axially-extending, integrally-molded, elongated spring tabs 144 may be replaced by a similar angled spring tab (not shown) which differs from spring tab 144 in that, rather than being axially-extending, it extends at some angle .Psi. with respect to the axial direction 114 where .Psi. is between 0 and 360 degrees.

In those embodiments of the universal nock system 100 in which it comprises an insert portion 134 having a middle portion 139 having a centering feature 150 of the middle portion 139, the middle portion 139 may have a plurality of contact surfaces 152. In some embodiments, the contact surfaces 152 may each be defined by an axially-extending, integrally-molded, elongated spring tab 154 having a free end biased outwardly in a radial direction 115 and adapted to be radially deflected upon insertion of the insert portion 134 into an associated arrow body 104. As can be seen in the non-limiting embodiment shown in FIGS. 5*a* and 5*b*, the contact surfaces 152 each define an axially-extending, integrally-molded, elongated spring tab 154 which may be adapted to interlock with a corresponding aperture 107 in an associated arrow body 104 when operationally engaged therewith. As shown in FIGS. 5*a* and 5*b*, as inserted into the associated arrow body 104, the spring tabs 154 would form an interference fit with the associated arrow body 104 such that the spring tab 144 will be deflected radially to relieve at least a portion of the interference during insertion. The nock portion 120 may be rotated with respect to the associated arrow body 104, such as, without limitation, by application of torsion through the interior surface 133, to bring one or more spring tabs 154 into alignment with a corresponding aperture 107 such that each aligned spring tab 154 will snap or lock into place in the corresponding aperture 107 and thereby positively lock the nock portion 120 in a definite orientation and position relative to the associated arrow body 104. Positively locking the nock portion 120 in a definite orientation and position relative to the associated arrow body 104, will also positively lock the bowstring reception surface 124 and the concave channels 126 of the nock portion 120 in a definite orientation and position relative to the associated arrow body 104 and relative to the fletching 105 thereon. In some embodiments, positively locking the bowstring reception surface 124 and the concave channels 126 of the nock portion 120 in a definite orientation and position relative to the fletching 105, establishes a desirable nock and fletching orientation. In some non-limiting embodiments, the centering feature 150 of the middle portion 139 has three contact surfaces 152, each offset from the other two contact surfaces 152 of the centering feature 150 of the middle portion 139 by 120 degrees. In some non-limiting embodiments, the centering feature 150 of the middle portion 139 has single contact surface 152. In some non-limiting embodiments, the centering feature 150 of the middle portion 139 has multiple contact surfaces 152, offset from one or more other contact surfaces 152 by some axial distance. In some non-limiting embodiments, one or more of the axially-extending, integrally-molded, elongated spring tab 154 may be replaced by a similar angled spring tab (not shown) which differs from spring tab 154 in that, rather than being axially-extending, it extends at some angle .Phi. with respect to the axial direction 114 where .Phi. is between 0 and 360 degrees.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A universal nock system comprising:

a first axis of elongation defining an axial direction and radial directions, each radial direction being perpendicular to the axial direction;

a nock portion having, a first side having a bowstring reception surface having multiple concave channels, a second side opposite the first side, and having an axial contact surface, and an exterior surface extending between the first side and the second side;

a substantially cylindrical insert portion extending from the second side of the nock portion, elongated along the first axis of elongation, and adapted for insertion into an associated arrow body, the insert portion having, a first end adjacent to the second side, a second end opposite the first end, the second end having a centering feature of the second end, the centering feature of the second end having a plurality of contact surfaces facing in a radial direction, and a middle portion located along the first axis of elongation between the first end and the second end, the middle portion having a centering feature of the middle portion, the centering feature of the middle portion having a plurality of contact surfaces facing in a radial direction;

wherein:

the bowstring reception surface has a number, N, of concave channels wherein N is at an integer greater than 2;

each channel is adapted to operationally receive an associated bowstring;

each channel is adapted to transmit forces from the associated bowstring during a firing operation;

each channel defines a channel axis that is substantially perpendicular to the first axis of elongation and is oriented at an angle .Theta. about the first axis of elongation with respect to at least one other channel axis;

Theta. is 360/N degrees;

the axial contact surface is adapted to engage the body of the associated arrow;

the axial contact surface is adapted to transmit forces from the associated bowstring during a firing operation;

the nock portion further comprises a interior surface defining a hole extending into the nock portion from the bowstring reception surface;

the interior surface defines a torque receptacle adapted to transmit a torque about the first axis of elongation;

the first end has an annular groove, adapted to serve as an overrun glue well;

adapted to serve as a geometric relief; and defined by a fillet radius tangent to the contact surface.

2. The universal nock system of claim 1, wherein each contact surface of the centering feature of the second end is defined by an axially-extending, integrally-molded, elongated spring tab having a free end biased outwardly in a radial direction and adapted to be radially deflected upon insertion of the insert portion into an associated arrow body; and is adapted to provide a radial reaction force on, and a corresponding frictional retaining force with, an associated arrow body when operationally engaged therewith.

3. The universal nock system of claim 1, wherein each contact surface of the centering feature of the middle portion is defined by an axially extending, integrally-molded elongated spring tab having a free end biased outwardly in a radial direction and adapted to be radially deflected upon insertion of the insert portion into an associated arrow body; and is adapted to interlock with a corresponding aperture in an associated arrow body when operationally engaged therewith.

4. The universal nock system of claim 1, wherein the centering feature of the second end has three contact surfaces, each offset from the other two contact surfaces of the centering feature of the second end by 120 degrees.

5. The universal nock system of claim 1, wherein the centering feature of the middle portion has three contact surfaces, each offset from the other two contact surfaces of the centering feature of the middle portion by 120 degrees.

6. The universal nock system of claim 1, wherein N is 3.

7. An arrow nock comprising:

a first axis of elongation defining an axial direction and radial directions, each radial direction being perpendicular to the axial direction;

a first axial end having a bowstring reception surface; and a second axial end, opposite the first axial end, comprising an insert portion adapted for insertion into an associated arrow body;

wherein:

the insert portion comprises a first centering feature having a plurality of contact surfaces facing in a radial direction;

each contact surface of the first centering feature is defined by an axially-extending, elongated spring tab having a free end inherently biased outwardly in a radial direction and adapted to be radially deflected upon insertion of the insert portion into the associated arrow body; and each contact surface of the first centering feature is adapted to provide a radial reaction force on, and a corresponding frictional retaining force with, the associated arrow body when operationally engaged therewith; and an annular groove that is adapted to serve as an overrun glue well, adapted to serve as a geometric relief, and defined by a fillet radius tangent to the contact surface.

8. The arrow nock of claim 7 wherein:

the bowstring reception surface comprises multiple concave channels.

9. The arrow nock of claim 7 further comprising:

an axial contact surface that is adapted to engage the associated arrow body and to transmit forces from an associated bowstring to the associated arrow body during a firing operation.

10. The arrow nock of claim 7 wherein:

each contact surface of the first centering feature is adapted to interlock with a corresponding aperture in the associated arrow body when operationally engaged therewith.

11. The arrow nock of claim 7 wherein:

each contact surface of the first centering feature extends through an opening formed in a surface of the insert portion.

12. An arrow nock comprising:

a first axis of elongation defining an axial direction and radial directions, each radial direction being perpendicular to the axial direction;

a first axial end having a bowstring reception surface; and a second axial end, opposite the first axial end, comprising an insert portion adapted for insertion into an associated arrow body;

wherein:

the insert portion comprises a first centering feature having a plurality of contact surfaces facing in a radial direction;

each contact surface of the first centering feature is defined by an axially-extending, elongated spring tab having a free end inherently biased outwardly in a radial direction and adapted to be radially deflected upon insertion of the insert portion into the associated arrow body; and each contact surface of the first centering feature is adapted to provide a radial reaction force on, and a corresponding frictional retaining force with, the associated arrow body when operationally engaged therewith:

the insert portion comprises a second centering feature axially spaced from the first centering feature;

the second centering feature has a plurality of contact surfaces facing in a radial direction;

each contact surface of the second centering feature is defined by an axially-extending, elongated spring tab having a free end inherently biased outwardly in a radial direction and adapted to be radially deflected upon insertion of the insert portion into an associated arrow body; and each contact surface of the second centering feature is adapted to provide a radial reaction force on, and a corresponding frictional retaining force with, an associated arrow body when operationally engaged therewith.

13. The arrow nock of claim 12 wherein:

the insert portion has a circumference;

each contact surface of the second centering feature is circumferentially spaced from each other contact surface of the second centering feature;

each contact surface of the first centering feature is circumferentially spaced from each other contact surface of the first centering feature; and each contact surface of the second centering feature is circumferentially spaced from each contact surface of the first centering feature.

14. The arrow nock of claim 12 wherein:

each contact surface of the first centering feature extends through an opening formed in a surface of the insert portion.

15. The arrow nock of claim 7 further comprising an annular groove that is:

adapted to serve as an overrun glue well;

adapted to serve as a geometric relief; and defined by a fillet radius tangent to the contact surface.

16. The arrow nock of claim 12 wherein the bowstring reception surface comprises multiple concave channels.

17. The arrow nock of claim 12 further comprising: an axial contact surface that is adapted to engage the associated arrow body and to transmit forces from an associated bowstring to the associated arrow body during a firing operation.

* * * * *